US012285091B2

(12) United States Patent
Couvidat et al.

(10) Patent No.: US 12,285,091 B2
(45) Date of Patent: Apr. 29, 2025

(54) LUGGAGE-TYPE BAGGAGE ARTICLE

(71) Applicant: HERMES SELLIER, Paris (FR)

(72) Inventors: Franck Couvidat, Saint Molf (FR); Mickael Lépine, Le Luart (FR); Vincent Le Men, La Ferte-Bernard (FR)

(73) Assignee: HERMES SELLIER, Paris (FR)

( * ) Notice: Subject to any disclaimer, the term of this patent is extended or adjusted under 35 U.S.C. 154(b) by 262 days.

(21) Appl. No.: 17/794,977

(22) PCT Filed: Jan. 18, 2021

(86) PCT No.: PCT/FR2021/050083
§ 371 (c)(1),
(2) Date: Jul. 24, 2022

(87) PCT Pub. No.: WO2021/148745
PCT Pub. Date: Jul. 29, 2021

(65) Prior Publication Data

US 2023/0069009 A1 Mar. 2, 2023

(30) Foreign Application Priority Data

Jan. 24, 2020 (FR) ..... 2000711

(51) Int. Cl.
*A45C 13/26* (2006.01)
*A45C 5/03* (2006.01)

(52) U.S. Cl.
CPC ..... *A45C 13/262* (2013.01); *A45C 5/03* (2013.01); *A45C 2005/037* (2013.01); *A45C 2013/267* (2013.01)

(58) Field of Classification Search
CPC .... A45C 13/262; A45C 5/03; A45C 2005/037
(Continued)

(56) References Cited

U.S. PATENT DOCUMENTS 5,371,923 A * 12/1994 Chang ..... B62B 1/125 280/655
5,553,350 A * 9/1996 Chang ..... A45C 13/262 16/113.1

(Continued)

FOREIGN PATENT DOCUMENTS

EP 3318158 A1 * 5/2018 ..... A45C 13/262

*Primary Examiner* — Nathan J Jenness
*Assistant Examiner* — Jessica Kavini Tamil
(74) *Attorney, Agent, or Firm* — NIXON & VANDERHYE

(57) ABSTRACT

An item of luggage includes an extendable and retractable handle mechanism having a handle axle to which a grip portion is mechanically connected. An elongate member is mounted to be movable in translation relative to a fixed sheath partly housing a locking/unlocking system, which is mechanically connected to elongate member. An interface system is actuated by the handle axle and actuates the locking/unlocking system. A support member forms a housing for a portion of the handle axle and the interface system. The support member includes a wall forming a guide and a stop for rotational movement of the interface system and of the handle axle between first and second positions of the grip portion and the handle axle. In the first position, the locking/unlocking system locks the handle in a selected position. In the second position, obtained by the rotation of the grip portion, the locking/unlocking system unlocks the handle.

24 Claims, 15 Drawing Sheets

(58) Field of Classification Search
USPC ..... 190/115; 16/113.1, 405–430
See application file for complete search history.

(56) References Cited

U.S. PATENT DOCUMENTS

| | | | | |
|---|---|---|---|---|
| 5,970,579 | A | 10/1999 | Lu | |
| 2018/0125192 | A1* | 5/2018 | Meersschaert ..... | A45C 13/262 |

* cited by examiner

LUGGAGE-TYPE BAGGAGE ARTICLE

RELATED APPLICATIONS

This application is a § 371 application of PCT/FR2021/050083 filed Jan. 18, 2021, which claims priority from French Patent Application No. 2000711 filed Jan. 24, 2020, each of which is incorporated herein by reference in its entirety.

TECHNICAL FIELD OF THE INVENTION

The invention relates to a luggage-type baggage article, comprising at least two half-shells mechanically connected with each other at least partly by a closure mechanism, as well as an extendable and retractable handle mechanism which is at least partly housed in one of the half-shells. It may for example be a suitcase or a trunk, or any other article of the same kind.

STATE OF THE ART

Items of luggage are known comprising two half-shells and a closure mechanism, for example formed from a zip fastener and configured to link the two half-shells in a closed configuration of the luggage; and also a handle mechanism which is extendable and retractable and which is at least partly housed in one of the half-shells.

In particular, documents U.S. Pat. No. 5,553,350 and EP 3 318 158 describe mechanisms enabling the locking and the unlocking at any height of extension of a luggage handle, simply by rotationally actuating a movable part of the handle.

OBJECT AND SUMMARY OF THE INVENTION

The invention is directed to providing a luggage-type baggage article, of a similar kind and that has an improved extendable and retractable handle mechanism making its use particularly secure, while remaining simple and convenient.

The invention thus relates to a luggage-type baggage article, comprising at least two half-shells as well as a extendable and retractable handle mechanism which is at least partly housed in one of the half-shells and which is configured to lock/unlock a handle of the article in a position selected from a plurality of extension positions of the handle relative to the half-shells, by rotation of a grip portion of the handle; characterized in that the extendable and retractable handle mechanism comprises a handle axle to which is mechanically connected the grip portion which is able to rotate, at least one sheath mounted to be fixed in one of the half-shells, at least one elongate member of specific cross-section mounted to be movable in translation relative to the sheath, at least one locking/unlocking system mechanically connected to said at least one elongate member of specific cross-section and housed at least partly in said at least one sheath, at least one interface system configured to be actuated by the handle axle and to actuate the locking/unlocking system, and at least one support member forming a housing for a portion of the handle axle and furthermore for said at least one interface system, said at least one support member being provided with a wall forming at the same time a guide and a stop for said at least one interface system and for the handle axle between a first position of the grip portion and of the handle axle, where said at least one locking/unlocking system locks the handle in the selected position, and a second position of the grip portion and of the handle axle obtained by rotation of the grip portion, where said at least one locking/unlocking system unlocks the handle.

In the article according to the invention, the rotation of the grip portion of the handle from one to the other of the first and second positions of the handle and of the handle axle enable the locking/unlocking of the translation of the handle relative to the half-shells, for extending/retracting the handle. In other words, it is possible to adjust the height of the luggage handle.

The transmission of movement from the grip portion of the handle and thus from the handle axle to the locking/unlocking system is provided precisely and reliably by the support part which at the same time makes it possible to house the locking/unlocking system and a portion of the handle axle, and also to guide them when they are rotationally driven between the first position of the handle referred to as locking position and the second position of the handle, referred to as unlocking position, and vice-versa.

The support member wall can at the same time form a guide and a stop in relation to rotational and/or translational movement for the interface system.

Particularly simple, convenient and economical preferred features of the article of baggage according to the invention are presented below.

The extendable and retractable handle mechanism may be configured such that the first position of the grip portion and of the handle axle, designated locking position, is a stable position, while the second position of the grip portion and of the handle axle, designated unlocking position, is an unstable position, the extendable and retractable handle mechanism being furthermore configured to return the grip portion and the handle axle naturally to the first position.

As a variant, the extendable and retractable handle mechanism may be configured such that the second position of the grip portion and of the handle axle, designated unlocking position, is a stable position, while the first position of the grip portion and of the handle axle, designated locking position, is an unstable position, the extendable and retractable handle mechanism being furthermore configured to return the grip portion and the handle axle naturally to the second position.

In a further variant, each of the first and second positions may be a stable position.

Said at least one interface system may comprise a cam journal of cylindrical general shape, mechanically connected by a first end to the handle axle, and provided at a second end, which is an opposite end to the first end, with a transmission tip having a contact face configured to operate said at least one locking/unlocking system.

Said cam journal may be attached onto the handle axle.

Said cam journal may be mechanically connected to the handle axle using at least one fastening member, for example a pin, passing through the handle axle and of which at least one free end comes to be accommodated in at least one window provided in said cam journal.

Said at least one free end of said at least one fastening member may be configured to come into stopped engagement against a shoulder of the wall forming at the same time a guide and a stop for rotational movement of said at least one support member.

Said wall forming at the same time a guide and a stop for rotational movement of said at least one support member may be generally cylindrical and configured so that the cam journal is inserted through the latter, it being possible for the cam journal to have a positioning collar disposed in contact with said wall that forms at the same time a guide and a stop for rotational movement.

Said at least one interface system may comprise at least one elastic member, in particular for return of the grip portion of the handle at least from one of its second and first positions towards the other of its first and second positions, for example a torsion spring, mounted on the handle axle.

Said at least one interface system may comprise a spring journal to which is mechanically connected, by a first end, said at least one elastic member and in which is moveably mounted the handle axle, said at least one elastic member being interposed between said spring journal and said cam journal and being mechanically connected by a second end, which is an opposite end to its first end, to a side of said cam journal that is an opposite side to the aforementioned where the transmission tip is located.

Said at least one support member may be provided with a complementary wall forming at the same time a guide and a stop for translational movement for said spring journal and which is generally cylindrical and configured so that the spring journal is inserted through the latter, it being possible for the spring journal to have a positioning collar disposed in contact with said complementary wall that forms at the same time a guide and a stop for translational movement.

The complementary wall may be provided with a positioning cut-out configured to receive a positioning pin provided on the spring journal.

Said at least one interface system may comprise at least one push member having a complementary contact face configured to directly cooperate with the contact face of the transmission tip of said cam journal, and said at least one support member may comprise a complementary housing provided to slidingly receive said at least one push member.

The locking/unlocking system may comprise at least one tube movable inside said at least one elongate member of specific cross-section and configured to be actuated by said at least one push member.

Said locking/unlocking system may comprise at least one bushing which, in a first position of the grip portion and of the handle axle, is compressed and applied tightly against an inside face of said at least one sheath to hold said at least one elongate member of specific cross-section fixed relative to said at least one sheath, thus locking the handle in the selected position, and which, in a second position of the grip portion and of the handle axle obtained by rotation of the grip portion, is decompressed and enables free sliding of said at least one elongate member of specific cross-section in said at least one sheath, thus unlocking the handle.

The locking/unlocking system may comprise at least one sleeving member mechanically connected to said at least one elongate member of specific cross-section, and at least one bushing clamp mechanically connected to said at least one tube, said at least one bushing being mechanically connected both to said at least one sleeving member and to said at least one bushing clamp.

The locking/unlocking system may be configured such that the actuation of said at least one push member by the transmission tip of said cam journal drives the translational movement of said at least one tube in the elongate member of specific cross-section and at the same time of said at least one bushing clamp relative to said at least one sleeving member; and such that the translational movement of said at least one bushing clamp drives the compression or the decompression of said at least one bushing in its direction of translational movement.

The extendable and retractable handle mechanism may have a general shape of a U, with the grip portion of the handle and the handle axle forming a bottom of the U and each branch of the U being formed at least by a said sheath, a said elongate member of specific cross-section and a said locking/unlocking system.

As a variant, the extendable and retractable handle mechanism may have a general shape of an L, with the grip portion of the handle and the handle axle forming one branch of the L and the sheath, the elongate member of specific cross-section and the locking/unlocking system forming another branch of the L.

The half-shells may be mechanically connected with each other at least partly by a closure mechanism.

BRIEF DESCRIPTION OF THE DRAWINGS

The disclosure of the invention will now be continued with the description of embodiments, given below by way of illustrative and non-limiting examples, with reference to the accompanying drawings.

DETAILED DESCRIPTION OF THE EMBODIMENTS

Figure 1:
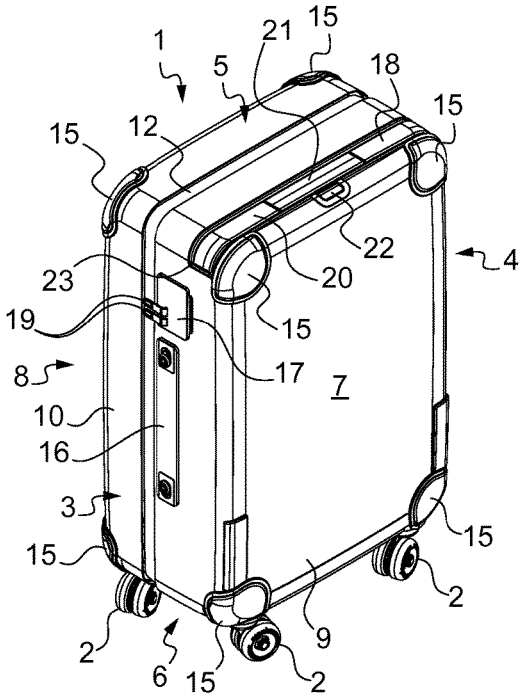
FIG. 1 is a diagrammatic perspective view on a corner of a luggage-type baggage article, in particular a suitcase in closed configuration with the handle mechanism stowed.

FIGS. 1 to 6 illustrate an article of baggage of luggage type, and in particular here a suitcase 1 with wheels 2, shown in closed configuration and from different viewing angles.

The suitcase 1 is of generally parallelepiped shape, having six sides, including a front wall 3, a back wall 4, upper and lower lateral walls 5 and 6, a bottom wall 7 and a top wall 8.

The upper lateral wall 5 and the lower lateral wall 6 are opposite walls and each extends to an end from the back wall 4 and to an opposite end from the front wall 3, which is an opposite wall to the back wall 4. The back and top walls 7 and 8 are opposite walls and are each connected to the front, back and upper and lower lateral walls 3, 4, 5 and 6.

The suitcase 1 is formed from a substantially rigid envelope having two half-shells called lower shell 9 and upper shell 10.

The lower and upper half-shells 9 and 10 define an internal space in the closed configuration of the suitcase 1.

The lower and upper half-shells 9 and 10 may be covered with ornamental dressing, for example of leather.

The wheels 2 of the suitcase 1 project from its lower lateral wall 6.

The suitcase 1 is provided at the location of the lower and upper half-shells 9 and 10 with reinforcing members 15.

The suitcase 1 comprises a fixed handle 16 mechanically connected to its front wall 3, substantially at mid-thickness of the suitcase.

Thickness is referred to here since it can be considered that the suitcase 1 generally has a height substantially defined by the distance separating the lateral walls 5 and 6; a width substantially defined by the distance between the front and back walls 3 and 4; and a thickness substantially defined by the distance separating the bottom and top walls 7 and 8.

The suitcase 1 has a linking strip (not visible) provided on its back wall 4.

The linking strip 11 forms a permanent join between the lower and upper half-shells 9 and 10.

The linking strip 11 furthermore forms a hinge for the passage of the suitcase 1 from its closed configuration to an open configuration (not shown) in which the lower and upper half-shells 9 and 10 are away from each other.

The suitcase 1 is provided with a zip fastener 12 which extends on either side of the linking strip 11, along the periphery of the luggage.

The periphery of the suitcase 1 is formed by the front wall 3 or fourth side, by the back wall 4 or first side, and by the lateral walls 5 and 6 or second and third sides.

The zip fastener 12 is configured to link the lower and upper half-shells 9 and 10 in the closed configuration of the suitcase 1.

The zip closure here comprises two pull tabs 19 provided to be moved towards the linking strip, via the front wall 3 then the respective lateral walls 5 and 6.

The suitcase 1 is provided with a lock 17 at least partly integrated into the envelope of the suitcase 1 and to which the two pull-tabs 19 may be connected mechanically and in a manner providing security, in the closed configuration of the suitcase 1, that is to say when the zip fastener 12 is closed.

The suitcase 1 further comprises an extendable and retractable handle 18 (hereinafter handle) and an extendable and retractable handle mechanism 20 (hereinafter called handle mechanism) which are here at least partly housed in the lower half-shell 9.

The handle mechanism 20 is configured to lock or unlock the handle 18 of the suitcase 1 in a position selected from a plurality of extension positions of the handle 18 relative to the lower and upper half-shells 9 and 10.

The handle mechanism 20 here has a general shape of a U, with the bottom of the U inserted into a housing 23 provided in the upper lateral wall 5 of the suitcase 1, when the handle 18 is retracted, and the branches of the U extending at least partly the length of the front and back walls 3 and 4 and towards the lower lateral wall 6.

The suitcase 1 further comprises an ejection button 22 which can be actuated from outside the suitcase 1 and which is housed in the upper lateral wall 5.

When the ejection button 22 is actuated, the handle 18 is automatically and partially ejected by a predetermined height.

Figure 3:
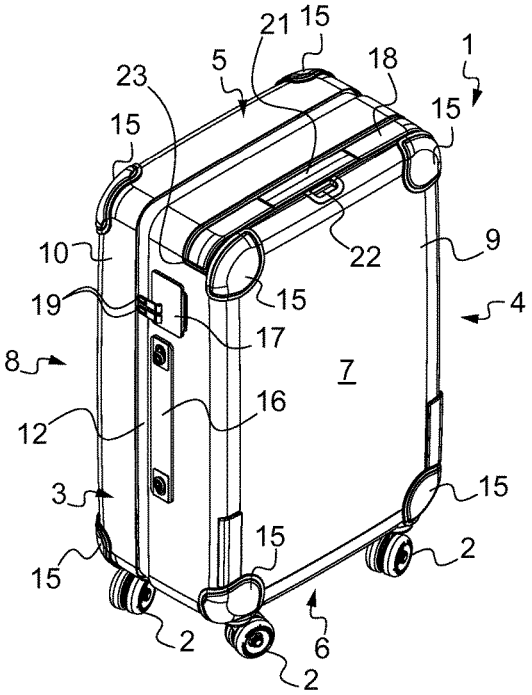
FIG. 3 is similar to FIG. 1, with a push-button pushed in, for the purpose of ejecting the handle.
Figure 4:
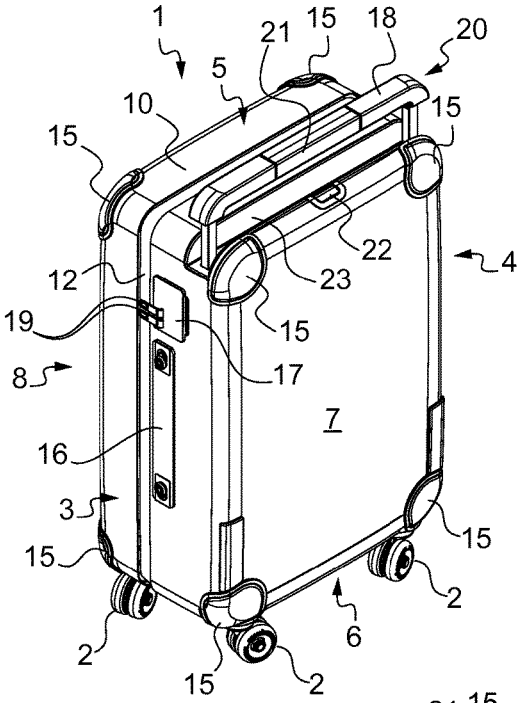
FIG. 4 is similar to FIGS. 1 and 3, with the handle ejected and projecting from the suitcase.

FIG. 1 shows the ejection button 22 not actuated, or not pushed, FIG. 3 shows the ejection button 22 actuated, or pushed and thus receded into the upper lateral wall 5, and FIG. 4 shows the ejection button 22 released. In FIG. 4, the handle 18 has been ejected.

Once the handle 18 has been ejected, it is possible to actuate the handle mechanism 20 to lock or unlock the handle 18 in a selected position.

This action is achieved by rotating the grip portion 21 of the handle 18.

The grip portion 21 is located here substantially in the center of the bottom of the U formed by the handle mechanism 20.

In the embodiment illustrated, it is not possible to actuate the handle mechanism 20 via the grip portion 21 before ejection of the handle 18 since the latter is located in the housing 23.

Figure 2:
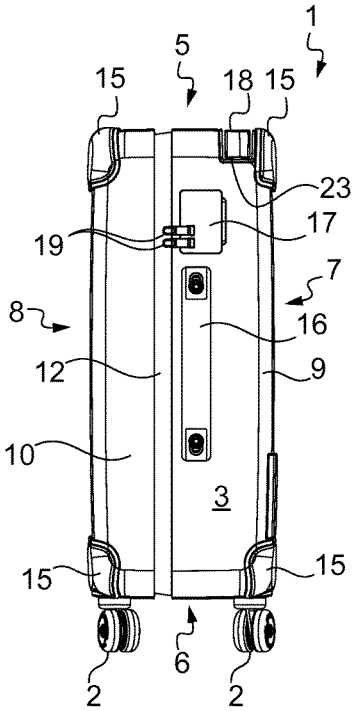
FIG. 2 is similar to FIG. 1, in side view.
Figure 5:
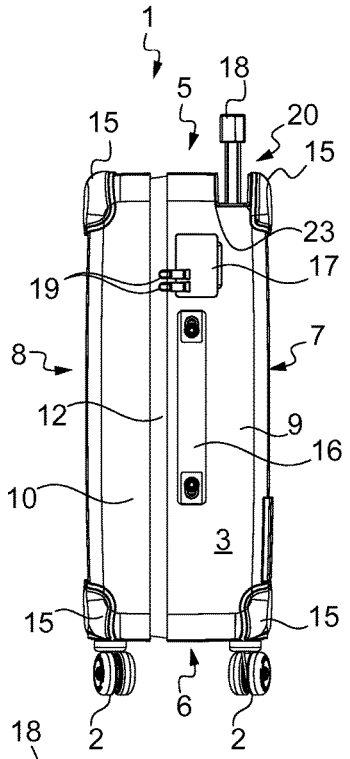
FIG. 5 is similar to FIG. 4, in side view.
Figure 6:
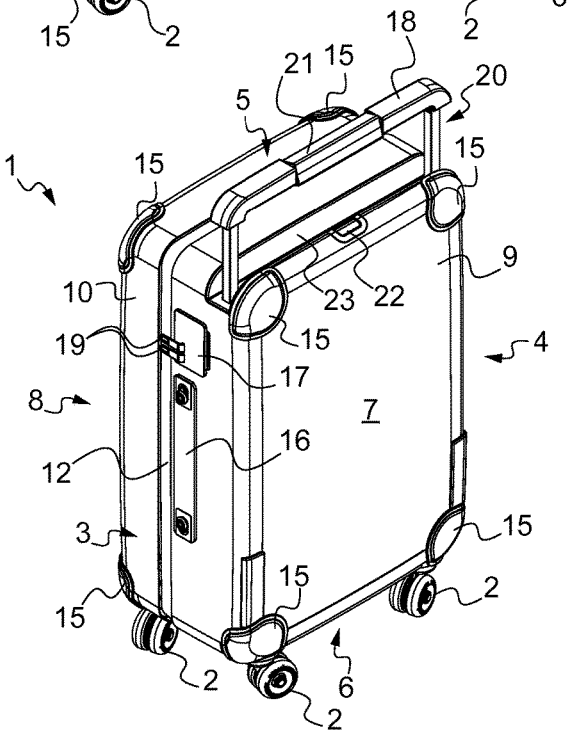
FIG. 6 is similar to FIGS. 1, 3 and 4, with a grip portion of the handle turned through a predetermined angle, for the purpose of unlocking the handle mechanism.

In FIGS. 1 and 2, the handle mechanism 20 is not actuated and the handle 18 is retracted. In FIGS. 3 to 5, the handle mechanism 20 has been actuated via the ejection button 22 to eject the handle 18. In FIG. 6, the handle mechanism 20 is actuated via the grip portion 21 for the purpose of extending the handle 18 to a selected position and to lock it in that position.

In the example embodiment illustrated and as explained below in more detail, once the handle 18 is in the selected position, it is locked by releasing the grip portion 21. To unlock the handle 18, it suffices once again to actuate the handle mechanism 20 via the grip portion 21 and to retract it towards the housing 23.

In other words, in a first position of the grip portion 21, referred to as locking position, the handle mechanism 20 locks the handle 18 in the selected position and, in a second position of the grip portion 21 obtained by rotating the grip portion 21, the handle mechanism 20 unlocks the handle 18 which can then be extended or retracted.

Figure 7:
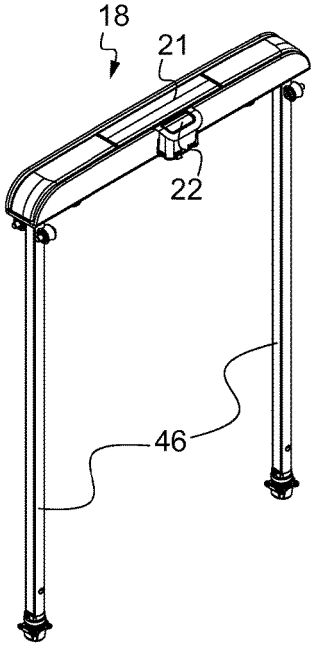
FIG. 7 is an isolated perspective view of the handle mechanism, in its configuration illustrated in FIGS. 1 and 2.
Figure 8:
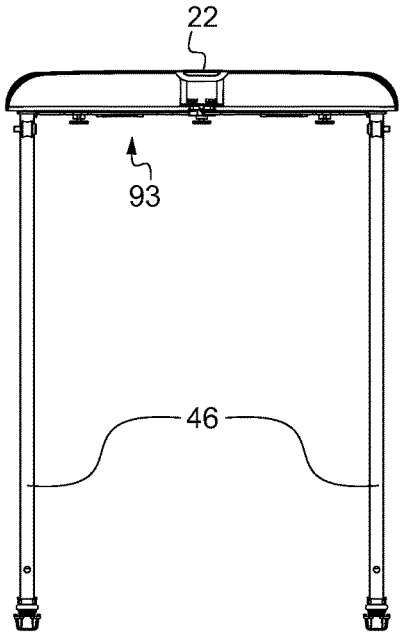
FIG. 8 is similar to FIG. 7, viewed from the front.
Figure 9:
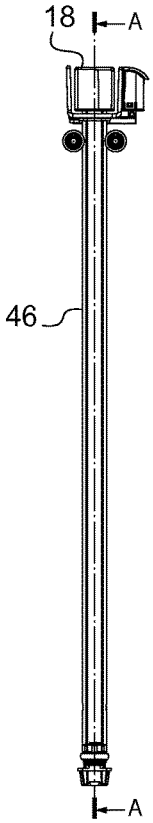
FIG. 9 is similar to FIG. 7, in side view.

FIGS. 7 to 9 show the handle mechanism 20 which has a general shape of a U. This is basically the part of the handle mechanism 20 which is extends at least partly from the lower half-shell.

In particular, located therein are the handle 18 with the grip portion 21 and the ejection button 22 which form at least partly the bottom of the U, which is also formed by a locking system 93 of the handle 18 which is actuated by the ejection button 22, while the branches of the U are formed here by elongate members of specific cross-section 46 (see below in detail).

FIGS. 10 to 16 show the handle mechanism 20, in different states, including partially assembled, partially dismantled and enlarged for some parts.

Figure 10:
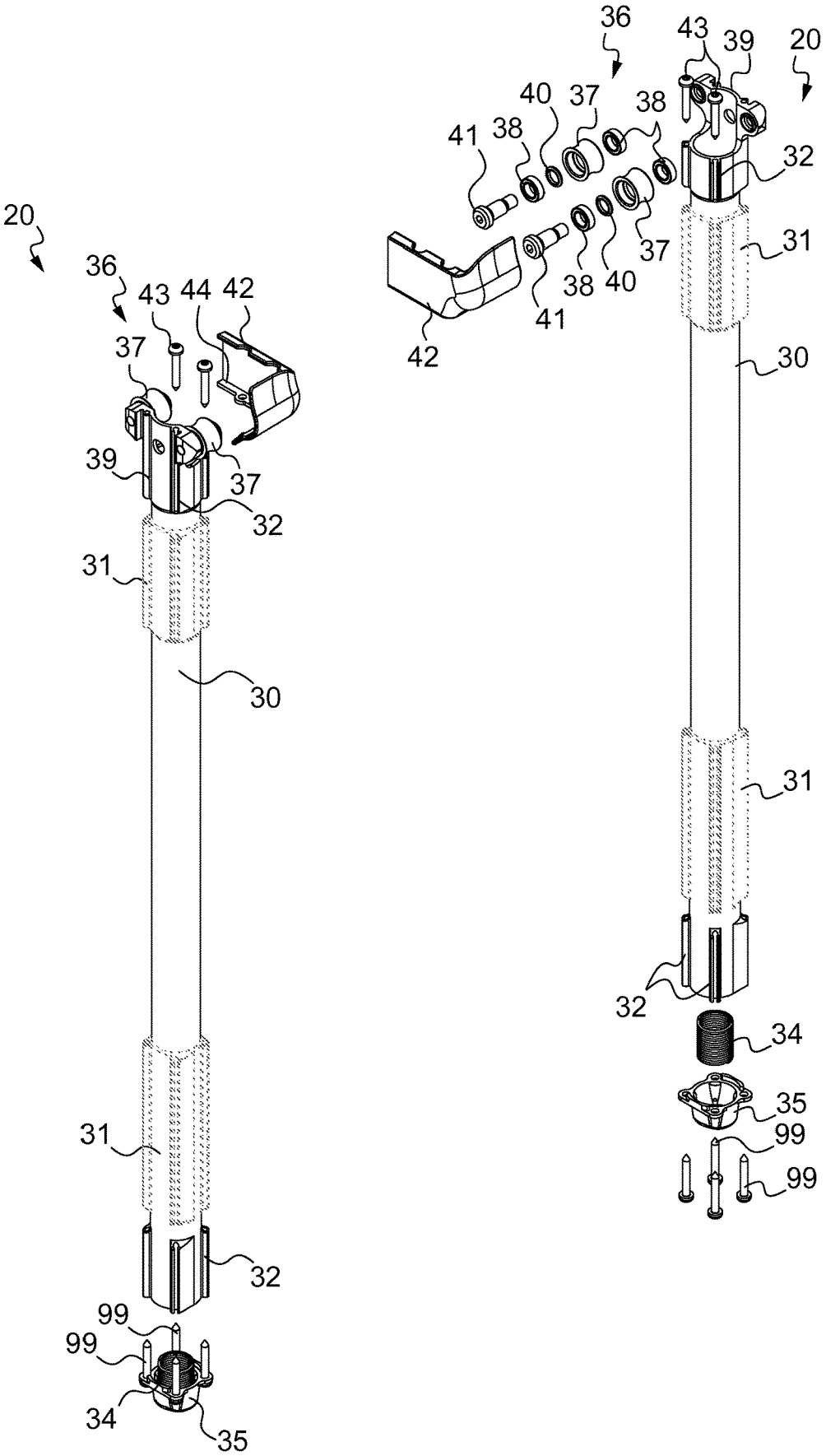
FIG. 10 is an isolated perspective view of part of the handle mechanism, partly assembled and partly in exploded view.

FIG. 10 shows part of the handle mechanism 20 configured to be entirely housed within the front and back walls 3 and 4.

The handle mechanism 20 here comprises two sheaths 30 mounted to be fixed respectively in the front and back walls 3 and 4.

Each sheath 30 is hollow and is of tubular form Each sheath 30 has, on an outside face, fastening cavities 32 and regions for mechanical connection 31, for example by bonding, to enable the holding of the sheaths 30 respectively in the front and back walls 3 and 4.

The handle mechanism 20 comprises, at the bottom of each sheath 30, an elastic ejection member 34, formed for example here by a compression spring, provided to eject the handle 18 when the ejection button 22 is actuated.

Each elastic ejection member 34 is partly housed in a tip member 35 mechanically connected at the bottom of the respective sheath 30, here for example through the intermediary of fastening screws 99 inserted into respective fastening cavities 32.

Each sheath 30 here has an enlarged internal section in which the elastic ejection member 34 of the handle 18 can extend (see below).

The handle mechanism 20 comprises, at the top of each sheath 30, a guiding system 36 formed from a plurality of rollers 37 and rolling bearings 38 secured to a lug 39 formed projecting at an upper end of the sheath 30.

Spacers 40 are accommodated here in the rollers 37, between the rolling bearings 38, and each assembly formed by a roller 37, a spacer 40 and two rolling bearings 38 is secured here to a lug 39 for example via fastening screws 41.

The handle mechanism 20 here comprises a casing 42 secured to the top of each sheath 30.

Each casing 42 is substantially in the form of a corner piece, with one branch of the corner piece located facing opposite the respective lug 39, and thus facing opposite the rollers 37 and rolling bearings 38, and which is secured here to a respective sheath 30 for example via fastening screws 43 inserted into the respective fastening cavities 32; and with the other branch of the corner piece extending behind an assembly formed by a roller 37, a spacer 40, and two rolling bearings 38.

The arrangement of the casings 42 facing the lugs 39 of the sheaths 30 makes it possible substantially to form protection at least for the guiding system 36.

Each casing 42 is provided with a re-entrant edge 44, directed towards the respective sheath 30 and slightly closing off the upper end of the sheath 30 which is open.

The re-entrant edge 44 of each casing 42 forms an end stop to the extension of the handle 18 (see below) with respect to the respective sheath 30.

Figure 11:
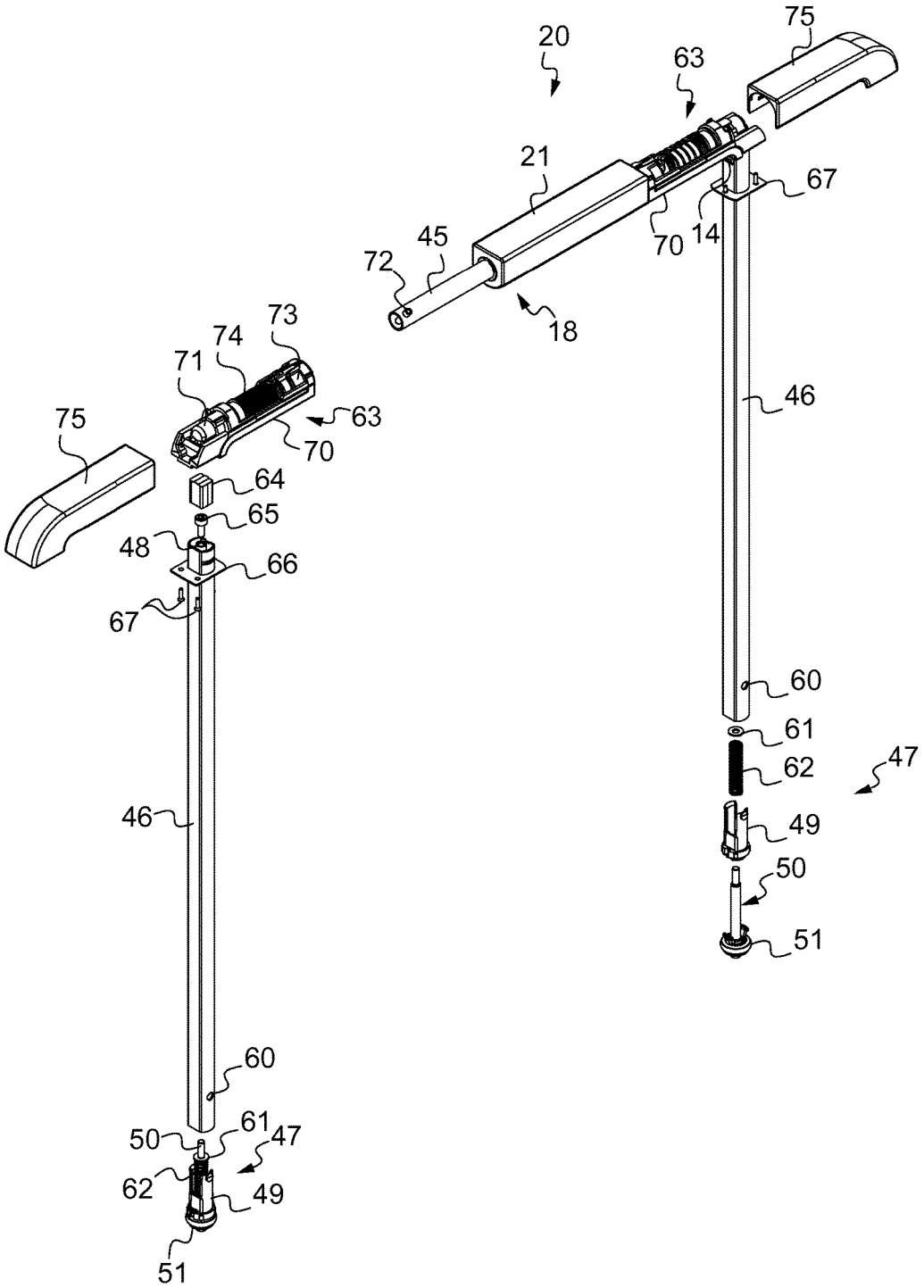
FIG. 11 is an isolated perspective view of another part of the handle mechanism, partly assembled and partly in exploded view.
Figure 12:
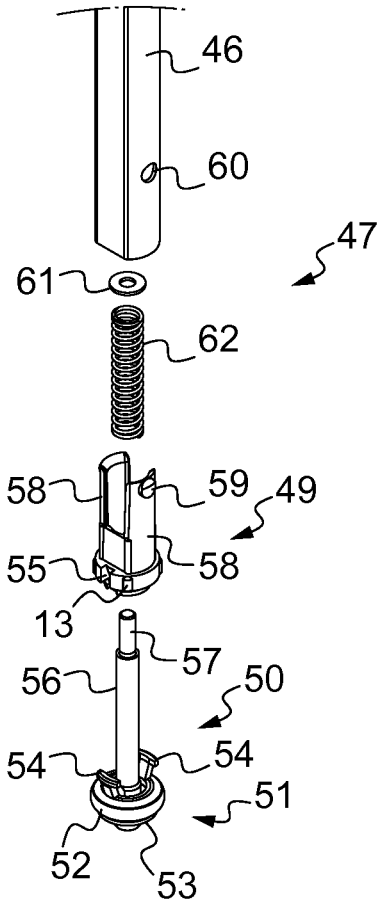
FIG. 12 is an enlargement of part of FIG. 11.
Figure 13:
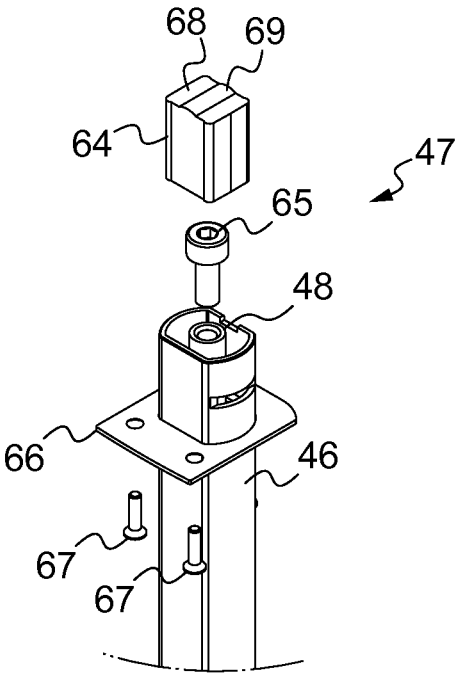
FIG. 13 is an enlargement of another part of FIG. 11.

FIG. 11 shows part of the handle mechanism 20 configured to be partly housed in the front and back walls 3 and 4 and to slide relative to the sheaths 30 and thus to be situated at least partly projecting from the lower half-shell 9; while FIGS. 12 to 15 illustrate in detail certain members of that mechanism part.

The handle mechanism 20 comprises a handle axle 45 to which is mechanically connected the grip portion 21 which is able to rotate.

The handle axle 45 projects on opposite ends of the grip portion 21 of the handle 18.

The handle mechanism 20 here comprises two elongate members of specific cross-section 46 configured to be mounted to be movable in translation relative to the sheaths 30.

It will be noted that the rollers that can be seen in FIG. 7 are configured to be in contact with lateral faces of a respective elongate member of specific cross-section 46.

The handle mechanism 20 comprises a locking/unlocking system 47 mechanically connected to each of the elongate members of specific cross-section 46, that is housed at least partly at the bottom of a respective sheath 30, and configured to be actuated by the handle axle 45.

In the embodiment described and illustrated, the handle mechanism 20 is configured such that the first position of the grip portion 21 and thus of the handle axle 45, or locking position, is a stable position, while the second position of the grip portion 21 and thus of the handle axle 45, or unlocking position, is an unstable position, the handle mechanism 20 being furthermore configured to return the grip portion 21 and also the handle axle 45 naturally to the first position.

As indicated earlier, the handle mechanism 20 here has a general shape of a U. The grip portion 21 of the handle 18 and the handle axle 45 form the bottom of the U and each branch of the U is formed by a sheath 30, an elongate member of specific cross-section 46 and a locking/unlocking system 47.

The locking/unlocking system 47 comprises a tube 48 movable within each elongate member of specific cross-section 46 and configured to be actuated by the handle axle 45, a sleeving member 49 mechanically connected to each elongate member of specific cross-section 46, and a bushing clamp 50 mechanically connected to the tube 48.

It will be noted that the elastic ejection members 34 visible in FIG. 10 are sandwiched between a respective tip member 35 which can also be seen in FIG. 10 and a lower face for a respective bushing clamp 50.

The locking/unlocking system 47 comprises bushings 51.

The locking/unlocking system 47 is, in the first position of the grip portion 21 and of the handle axle 45, configured to compress each bushing 51 so as to apply them tightly against the inside faces of the respective sheaths 30 to keep the respective elongate members of specific cross-section 46 fixed relative to the sheaths 30, thus locking the handle 18 in the selected position.

The locking/unlocking system 47 is, in the second position of the grip portion 21 and of the handle axle 45 obtained by rotating the grip portion 21, configured to decompress each bushing 51 so as to enable free sliding of the respective elongate members of specific cross-section 46 in the respective sheaths 30, thereby unlocking the handle 18.

Each bushing 51 is mechanically connected both to a respective sleeving member 49 and to a respective bushing clamp 50.

The locking/unlocking system 47 is configured such that the actuation of the handle axle 45 drives the translational movement of each tube 48 within a respective elongate member of specific cross-section 46 and at the same time of each bushing clamp 50 relative to the respective sleeving member 49.

The translational movement of the bushing clamp 50 drives the compression or decompression of a respective bushing 51 in its direction of movement.

Furthermore, each bushing clamp 50 is able to slide in the enlarged section of a respective sheath 30, even if the bushing 51 is compressed.

In the embodiment described and illustrated, each bushing 51 comprises a body 52 and each bushing clamp 50 comprises a base 53 around which is mounted the body 52 of the bushing 51.

Each bushing 51 further comprises one or more fastening lugs 54 provided projecting from the body 52 and each sleeving member 49 is provided with one or more cut-outs 55 in which are secured the fastening lug or lugs 54.

Each bushing clamp 50 further comprises a stem 56 which extends projecting from the base 53 and which has a narrowed end 57 mechanically connected with one end of a respective tube 48.

Each sleeving member 49 is mounted around the stem 56 of a respective bushing clamp 50 and each body 52 of a bushing 51 is sandwiched between a respective sleeving member 49 and a respective bushing clamp 50.

Each sleeving member 49 comprises extension walls 58 provided to be inserted into a respective elongate member of specific cross-section 46.

Each sleeving member 49 is provided with one or more positioning studs 59 provided on one or more of the extension walls 58, so forming snap-engagement members.

Each positioning stud 59 is configured to be accommodated in a corresponding aperture 60 provided in a respective elongate member of specific cross-section 46.

Each sleeving member 49 is provided here with gadroons 13 to facilitate the positioning of the sleeving member 49 in the respective elongate member of specific cross-section 46.

When the tubes 48 are actuated by the handle axle 45 in the second position of the latter, the tubes 48 push the respective bushing clamps 50 and moves them away from the respective sleeving members 49, thereby making it possible to decompress the body 52 of each bushing 51.

The locking/unlocking system 47 comprises an elastic member 62 mounted around each stem 56 of a respective bushing clamp 50, inside a respective sleeving member 49, between a first stop formed on a respective tube 48 and a second stop, which is an opposite stop to the first stop, formed in a respective sleeving member 49.

The first stop is formed here by a washer 61 partly accommodated in a groove (not shown) provided on each tube 48.

Each elastic member 62 is for example formed here by a spring naturally tending to act on the washer 61 and thus the respective tube 48.

Since each sleeving member 49 is fixed relative to the elongate member of specific cross-section 46, the elastic member 62 thus tends to direct the respective tube 48 upward and thus to bring closer the base 53 of the respective bushing clamp 50 so as to compress the body 52 of the respective bushing 51.

The handle mechanism 20 here comprises two interface systems 63 configured to be actuated by the handle axle 45 and to actuate each locking/unlocking system 47, through the intermediary of a respective push member 64 interposed between each locking/unlocking system 47 and each interface system 63.

In particular, each push member 64 has a substantially parallelepiped block shape and is configured to cap an upper free end of a respective tube 48, to which it is mechanically connected for example using a fastening screw 65.

Each push member 64 is provided, at an opposite end to the respective tube 48, with a contact face 68 referred to as complementary which here has a generally flat profile with a projecting protrusion 69, provided substantially in the center of the complementary contact face 68.

Each push member 64 is partially inserted in a respective elongate member of specific cross-section 46, by an upper end which is an opposite end to that at which the locking/unlocking system 47 is located.

At this same upper end of each elongate member of specific cross-section 46 is located a trim member 66 which protects access to the branches of the U formed by the handle mechanism 20.

This trim member 66 is furthermore mechanically connected, for example here using screws 67, to the bottom of the U formed by that handle mechanism 20, and in particular to a support part 70 which that handle mechanism 20 also comprises (see below).

Each interface system 63 comprises a cam journal 71, a spring journal 73, as well as an elastic member for return and/or positioning 74 and 75 interposed between the cam journal 71 and the spring journal 73.

Figures 14, 15, 16:
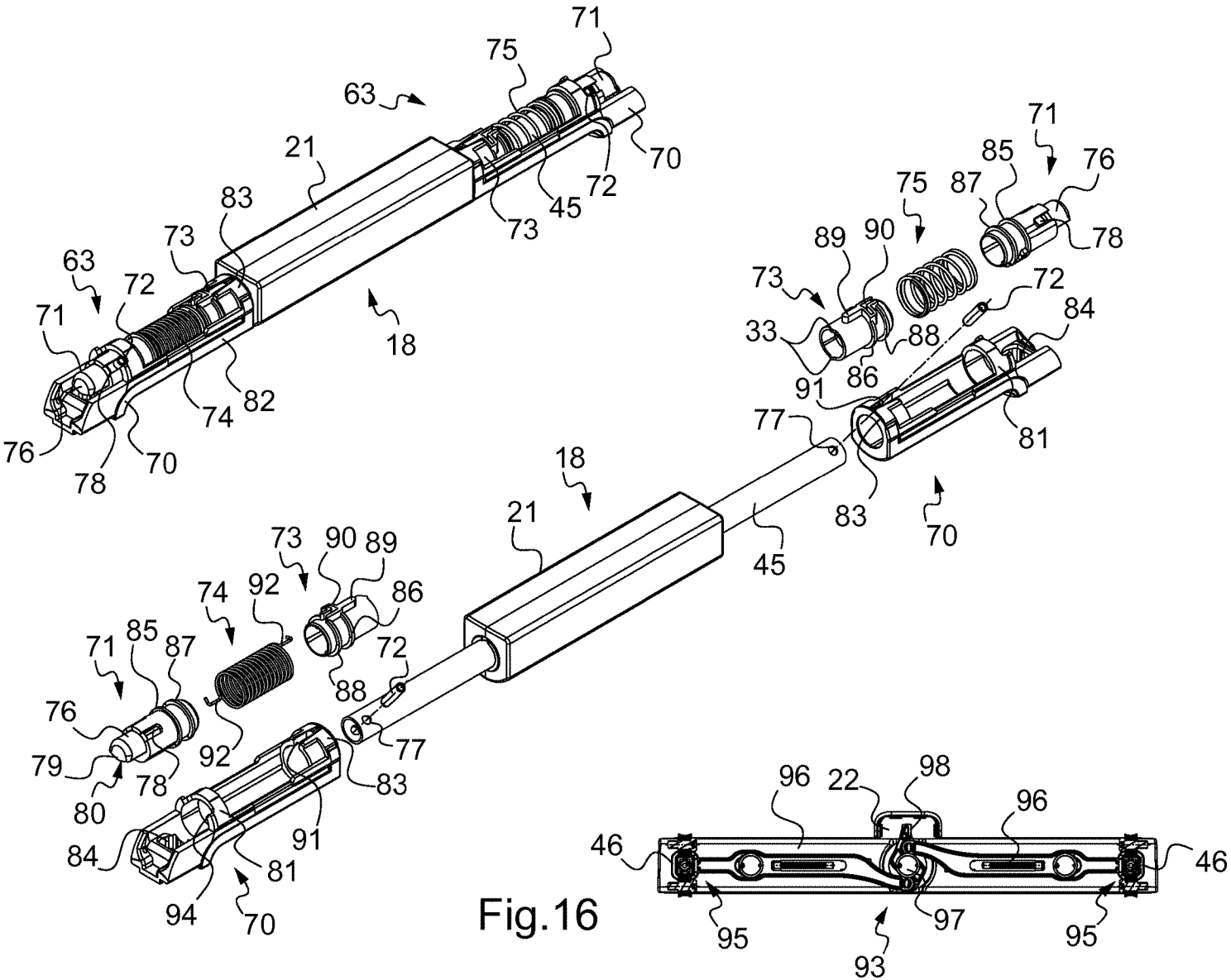
FIG. 14 is an isolated in perspective view of the top of the other part of the handle mechanism, in an assembled state.
FIG. 15 is similar to FIG. 14, except that the top of the other part of the handle mechanism can be seen in exploded view.
FIG. 16 is a cross section view on E-E in FIG. 17.

It will be noted that on the left of FIGS. 14 and 15, the elastic member is formed at the same time by a return and positioning spring 74. Such a return and positioning spring 74 is configured to return the handle axle 45 and the grip portion 21 from its second position towards its first part and is furthermore configured to place under stress the spring journal 73 on the support part 70, or even also to place under stress the cam journal 71 in relation to the respective push member 64 and thus in relation to the respective elongate member of specific cross-section 46.

On the right of FIGS. 14 and 15, the elastic member is formed by a positioning spring 75 configured to place under stress the spring journal 73 on the support part 70, or even also place under stress the cam journal 71 in relation to the respective push member 64 and thus in relation to the respective elongate member of specific cross-section 46.

Each cam journal 71 is of generally cylindrical shape, mechanically connected by a first end on the handle axle 45, and provided at a second end, which is an opposite end to the first end, with a transmission tip 76 having a contact face 79 which, in a first position of the grip portion 21 and of the handle axle 45, is configured to actuate a locking/unlocking system 47, via the respective push member 64, so as to lock the handle 18 in the selected position and which, in a second position of the grip portion 21 and of the handle axle 45 obtained by rotating the grip portion 21, is configured to actuate the respective locking/unlocking system 47 so as to unlock the handle 18.

The contact face 79 of the transmission tip 76 of each cam journal 71 here presents a profile having a general ramp shape directed towards a projecting end 80.

The contact face 79 of the transmission tip 76 of each cam journal 71 is configured to cooperate directly with the complementary contact face 68 of a respective push member 64.

Each interface system 63 is configured such that, in the first position of the grip portion 21 and of the handle axle 45, the projecting end 80 of the profile having a general ramp shape of the contact face 79 of the respective cam journal 71 is substantially in contact with the protrusion 69 projecting from the complementary contact face 68 of the respective push member 64.

Each interface system 63 is moreover configured such that, in the second position of the grip portion 21 and of the handle axle 45, it is the profile having a general ramp shape of the contact face 79 of the respective cam journal 71 which comes substantially into contact with the protrusion 69 projecting from the complementary contact face 68 of the respective push member 64.

Thus, each locking/unlocking system 47 is configured such that the actuation of the respective push member 64 by the transmission tip 76 of the respective cam journal 71 drives the translational movement of the respective tube 48 in the respective elongate member of specific cross-section 46, and at the same time the translational movement of the respective bushing clamp 50 relative to the respective sleeving member 49, while the translational movement of the bushing clamp 50 drives the compression or decompression of the respective bushing 51 in its direction of translational movement.

In the embodiment described and illustrated, each cam journal 71 is mounted on the handle axle 45.

Each cam journal 71 is mechanically connected on the handle axle 45 using a fastening member 72.

Here this may for example be a pin which passes through holes 77 provided in the handle axle 45, on each side of the grip portion 21, and of which the free ends come to be accommodated in windows 78 provided in the respective cam journals 71.

The free ends of the pins 72 are configured here to form stops in relation to rotation of the handle axle 45 and thus of the grip portion 21 (see below).

Each spring journal 73 is mounted moveably on the handle axle 45 and is mechanically connected by a first end, to the respective spring 74 or 75, itself mounted around the handle axle 45.

The springs 74 and 75 are furthermore mechanically connected by a second end, which is an opposite end to the respective first end, on one side of the respective cam journal 71 which is an opposite side to the side of the latter where the transmission tip 76 is located.

Each support part 70 (already introduced above) of the handle mechanism is configured to at least partly house together a respective portion of the handle axle 45, a respective interface system 63, including a cam journal 71, a spring journal 73, one of the springs 74 or 75, as well as a respective push member 64.

Each support part 70 extends generally longitudinally and has a substantially channel shaped base 82, a wall 81 of arch form which projects from the base 82 to have a generally cylindrical form, a complementary wall 83 also of arch form and which projects from the base 82 to have a generally cylindrical form, as well as a complementary housing 84 provided transversely in the base 82.

The complementary wall 83 is provided on a first side of the support part 70 and forms an insertion aperture for the respective portion of the handle axle 45.

The complementary housing 84 is provided substantially vertically in the base 82, on a second side of the support part 70, which is an opposite side to its first side.

The complementary housing 84 is provided to receive a portion of an elongate member of specific cross-section 46 and the push member 64 inserted into the aforementioned.

The wall 81 is provided substantially in the vicinity of the complementary housing 84.

The wall 81 at the same time forms a guide and stop in relation to rotation for the respective interface system 63 and for the handle axle 45 between the first position of the grip portion 21 and the handle axle 45, in which the locking/unlocking system 47 locks the handle 18 in the selected position, and the second position of the grip portion 21 and of the handle axle 45 obtained by rotating the grip portion 21, in which the locking/unlocking system 47 unlocks the handle 18.

The wall 81 that at the same forms a guide and stop in relation to rotation is configured such that the cam journal 71 is inserted through that wall, with the cam journal 71 being provided with a positioning collar 85, or shoulder, disposed in contact with the wall 81.

The wall 81 is provided with a shoulder 94 against which the free ends of the pins 72 come to be stopped in the second position of the grip portion 21 and of the handle axle 45.

The complementary wall 83 forms at the same time guide and stop in relation to translational movement for the spring journal 73 and is configured such that the spring journal 73 is inserted through that wall, the spring journal 73 having a positioning collar 86, or shoulder, disposed in contact with the complementary wall 83.

As regards the spring 74 or 75, this is interposed between a complementary collar 87, or shoulder, provided on the cam journal 71 and a complementary collar 88, or shoulder, provided on the spring journal.

The spring journal 73 is provided with a fastening cut-out 90 configured to receive if required a fastening lug 92 of the return spring 74.

The cam journal 71 is provided with a similar fastening cut-out (not shown) configured to receive if required an opposite fastening lug 92 of the return spring 74.

The complementary wall 83 is furthermore provided with a positioning cut-out 91 configured to receive a positioning pin 89, or cotter, provided on the spring journal 73.

Each spring journal 73 further comprises bosses 33 provided projecting from the free end of the spring journal 73 towards the complementary wall 83, which wall comprises complementary recesses (not illustrated) provided to receive these bosses 33.

The presence of such bosses 33 creates slight resistance to rotation, in the manner of a start threshold, to pass from the first position of the grip portion 21 towards its second position.

FIG. 16 shows in more detail the locking system 93 of the handle 18 which can be actuated by the ejection button 22.

The locking system 93 is provided with two locking fingers 95, or catches, configured to form upper stops and prevent the sliding of the elongate members of specific cross-section 46.

In particular, each elongate member of specific cross-section 36 is provided with a cut-out 14 (see FIG. 11) provided at its upper end to enable the passage of a respective locking finger 95.

The locking system 93 comprises two actuating arms 96 from which project the locking fingers 95 and which are configured to bring towards or away the locking fingers 95, or catches, from the elongate members of specific cross-section 46, via a pivoting movement generated around a pivot part 97.

The pivot part 97 is moved by the actuation of the ejection button 22 which acts on an actuating lug 98 projecting from the pivot part 97.

In particular, when the ejection button 22 is actuated, the latter acts on the actuating lug 98 which rotationally drives the pivot part 97, which translationally drives the actuating arms 96 to move away the locking fingers 95 until they come out of the cut-outs 14 of the elongate members of specific cross-section 46 and thus enable the sliding of these latter. The elongate members of specific cross-section 46 and more generally the handle 18 are then automatically ejected by the elastic ejection members 34, through a predetermined height substantially corresponding to the enlarged section of the sheaths 30.

In the suitcase 1 described above, the rotation of the grip portion 21 of the handle 18 from one to the other of the first and second positions of the handle 18 and of the handle axle 45 enable the locking/unlocking of the translation of the handle 18 relative to the lower and upper half-shells 9 and 10, for extending/retracting the handle 18.

In other words, it is possible to adjust the height of the handle 18 of the suitcase 1.

The locking of the handle 18 in a selected position is obtained here by expansion of the bushing 51 and thus by friction between the bushing 51 and the inside face of the sheath 30, thereby generating mechanical resistance between the surfaces that are in tight contact.

The mechanical resistance generated is sufficient to prevent the translational movement of the elongate member of specific cross-section 46 in the sheath 30 when the user of the suitcase 1 imparts translational movement to the aforementioned, whether for example when he carries it or when he wheels it.

The use of the phenomenon of friction using a bushing 51 is advantageous since it enables improved ergonomics in the use of the suitcase 1.

The locking/unlocking system 47 based on a bushing 51 is quiet since the compression and decompression of the bushing 51 is carried out noiselessly.

What is more, the locking/unlocking system 47 based on a bushing 51 makes it possible to improve the guiding of the elongate member of specific cross-section 46 inside the sheath 30 since even in its decompressed state in which the bushing 51 allows translation of the elongate member of specific cross-section 46 relative to the sheath 30, the bushing 51 may be located substantially in contact with the inside face of the sheath 30.

Such a non-tight contact does not generate mechanical resistance between the surfaces like that mentioned above, but this can enable take up of play provided between the elongate member of specific cross-section 46 and the sheath 30.

In other words, this taking-up of play promotes the guiding of the elongate member of specific cross-section 46 and makes the handle mechanism 20 more ergonomic.

Furthermore, in the suitcase 1 described above, the transmission of the movement from the grip portion 21 of the handle 18 and thus from the handle axle 45 to the locking/unlocking system 47 is carried out by the contact face of the transmission tip 76 of the cam journal 71, which is mechanically connected to the handle axle 45.

Such an interface may be manufactured with high precision so as to generate particularly little play between the rotation of the grip portion 21 of the handle 18 and the locking/unlocking of the translational movement of the handle 18 relative to the lower and upper half-shells 9 and 10.

Such transmission of movement from the grip portion 21 of the handle 18 and thus from the handle axle 45 to the locking/unlocking system 47 is moreover provided precisely and reliably by the support part 70 which at the same time makes it possible to house the locking/unlocking system 47 and a portion of the handle axle 45, and also to guide them when they are rotationally driven between the first locking position of the handle 18 and the second unlocking position of the handle 18, and vice-versa.

FIGS. 17 to 32 show the different steps to pass from the first locked position of the handle 18 in which it is in a retracted configuration, to its second unlocked position to pass it into an extended configuration, then back to its first locked position, but in its extended configuration, that is to say at a selected height. These steps are carried out thanks to the handle mechanism 20 described above with reference to the embodiment of the handle mechanism 20 illustrated in particular in FIGS. 7 to 16.

FIGS. 17 to 20 are similar views to those of FIGS. 7 to 9, but showing the handle mechanism 20 in partial cross-section, in the first locked position of the handle 18 in which it is located in the retracted configuration.

Neither the grip portion 21, nor the ejection button 22 are acted upon.

Therefore, the locking system 93 is in a configuration in which the locking fingers 95 prevent the sliding of the elongate members of specific cross-section 46, with these latter totally or practically totally inserted into the sheaths (not shown in these Figures), such that the elastic ejection member 34 is compressed between the bushing clamp 50 and the tip member 35.

The projecting end 80 of the contact face 79 of the transmission tip 76 of each cam journal 71 is substantially in contact with the protrusion 69 projecting from the contact face 68 of a respective push member 64.

The free ends of the pins 72 are at a distance from the shoulder 94 provided on the wall 81 of the cam journal 71.

In these conditions, the tubes 48 are acted upon and the elastic members 62 hold the bushing clamps 50 as close as possible to the sleeving members 49 such that the bushings 51 are compressed.

The compressed bushings 51 are located here in the part of the sheaths that has an enlarged internal section.

Figure 22:
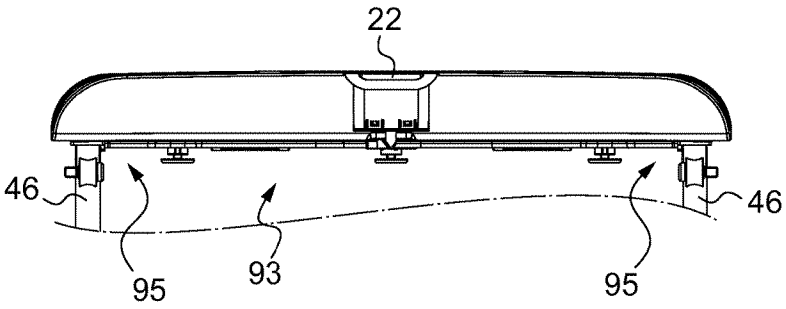
FIG. 22 is similar to FIG. 19, viewed from the front.
Figure 23:
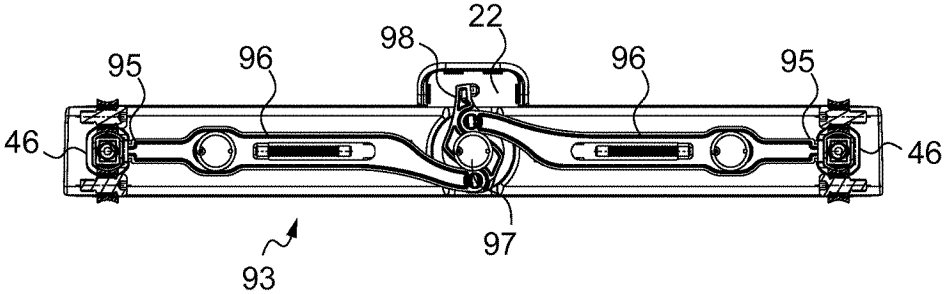
FIG. 23 is a similar cross-section to that of FIG. 16, but in the configuration illustrated in FIGS. 3, 21 and 22.
Figure 21:
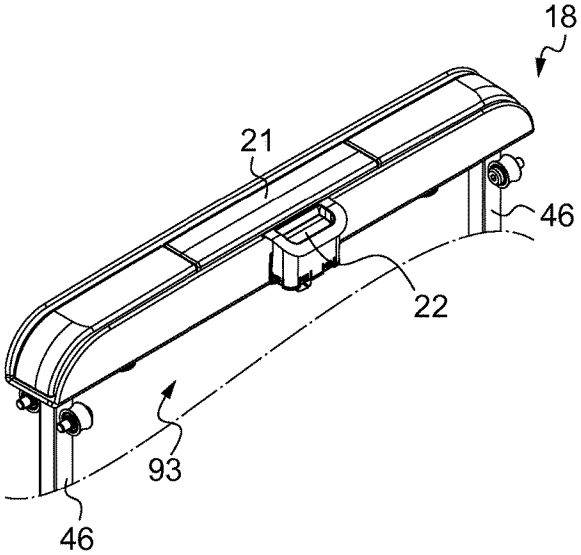
FIG. 21 is an isolated partial perspective view of the handle mechanism, in its configuration illustrated in FIG. 3.

FIGS. 21 to 23 show the actuation of the ejection button 22, located adjacent to the grip portion 21, for the purpose of operating the locking system 93 and thus of ejecting the elongate members of specific cross-section 46 and thus the handle 18 to a predetermined height.

The fact of pressing on the ejection button 22 makes it possible to act on the actuating lug 98 which rotationally drives the pivot part 97, which translationally drives the actuating arms 96 to move the locking fingers 95 away from the elongate members of specific cross-section 46 and thereby enable the sliding of these latter.

The elongate members of specific cross-section 46 and more generally the handle 18 are then automatically ejected by the elastic ejection members 34, through a predetermined height substantially corresponding to the enlarged section of the sheaths 30.

Figure 24:
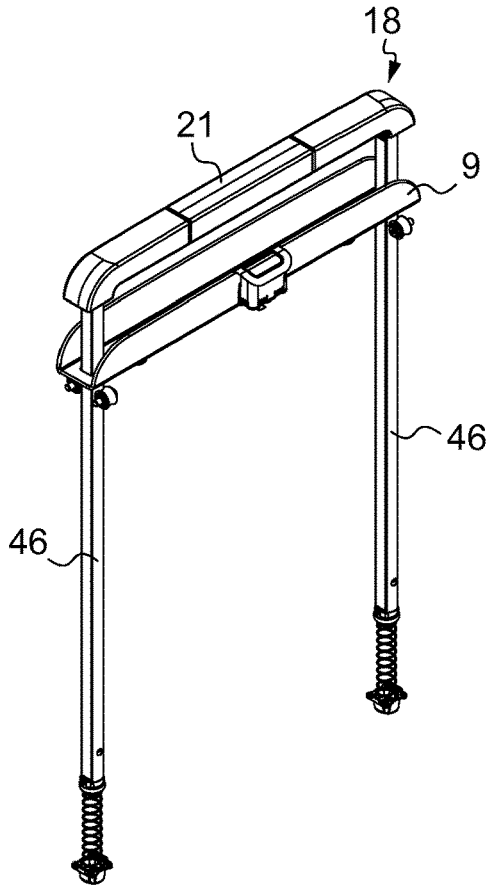
FIG. 24 is an isolated perspective view of the handle mechanism, in its configuration illustrated in FIGS. 4 and 5.
Figure 25:
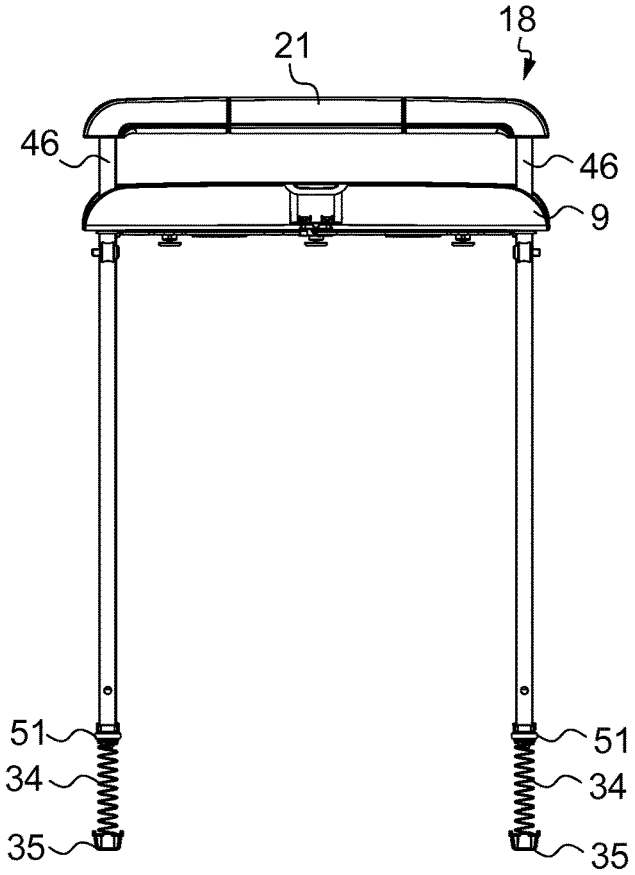
FIG. 25 is similar to FIG. 24, viewed from the front.
Figure 26:
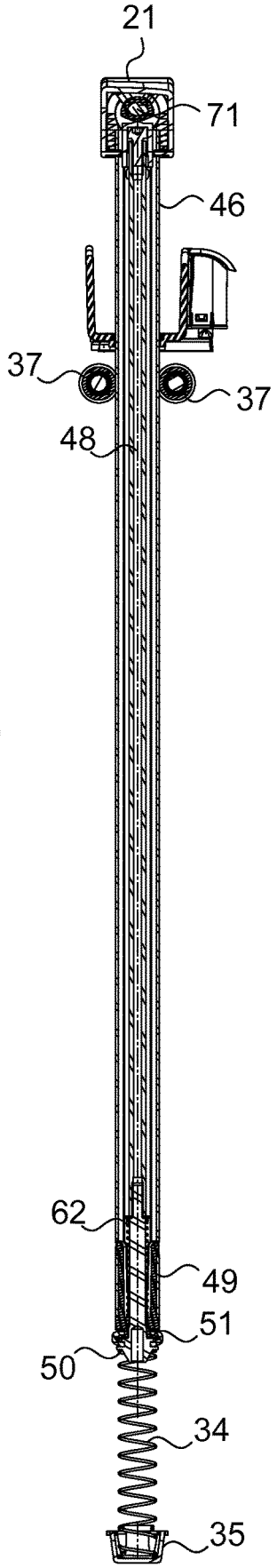
FIG. 26 is a similar cross-section to that of FIG. 20, except that it is entire and that it shows the configuration illustrated in FIGS. 4, 5, 24 and 25.

FIGS. 24 to 26 show the handle 18 ejected to a predetermined height which substantially corresponds to the height of the enlarged internal section provided in each sheath (not illustrated).

In particular, the elongate members of specific cross-section 46 are located partly projecting from the lower half-shell 9 (partly illustrated) even though the grip portion 21 of the handle 18 has not been actuated.

Figure 20:
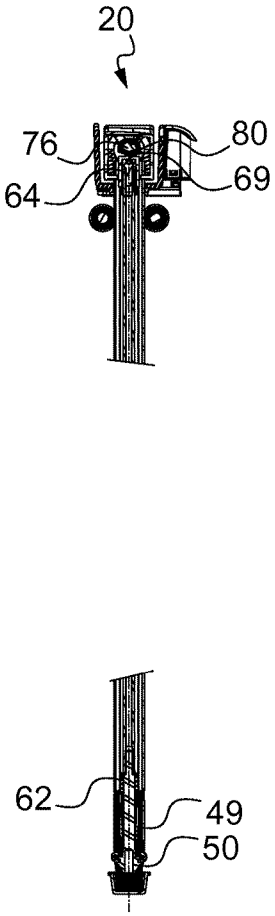
FIG. 20 is a partial cross section view on D-D in FIG. 17.
Figure 19:
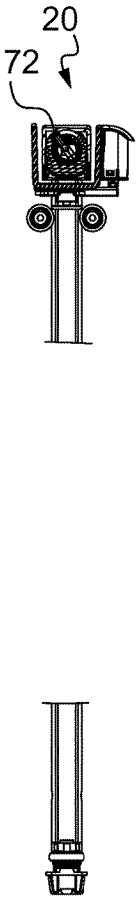
FIG. 19 is a partial cross section view on C-C in FIG. 17.
Figure 18:
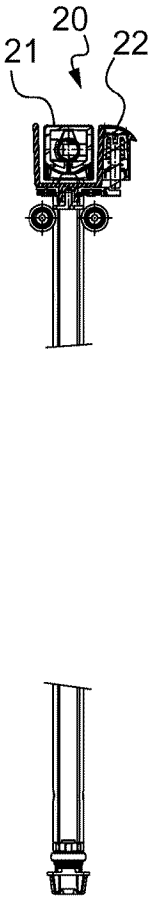
FIG. 18 is a partial cross section view on B-B in FIG. 17.
Figure 17:
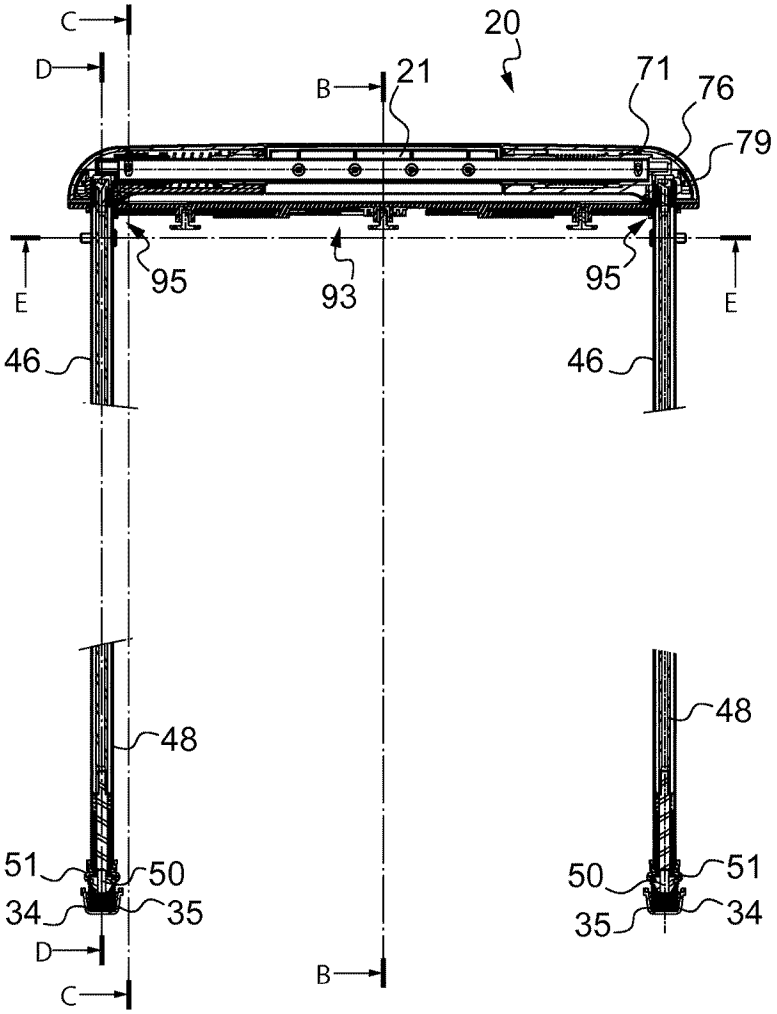
FIG. 17 is a partial cross section view on A-A in FIG. 9.

The cam insert 71 is in the same position as in FIG. 20 (it has not been turned) and the tubes 48 are not acted upon and the elastic members 62 hold the bushing clamps 50 as close as possible to the sleeving members 49 such that the bushings 51 are compressed.

However each assembly formed by an elongate member of specific cross-section 46, a tube 48 and also by a sleeving member 49, a bushing clamp 50, an elastic member 62 and by a bushing 51, has been slid upward by the force applied to each elastic ejection member 34, while bearing on the respective tip member 35.

The compressed bushings 51 have thus been slid along the enlarged internal sections of the sheaths.

Figure 27:
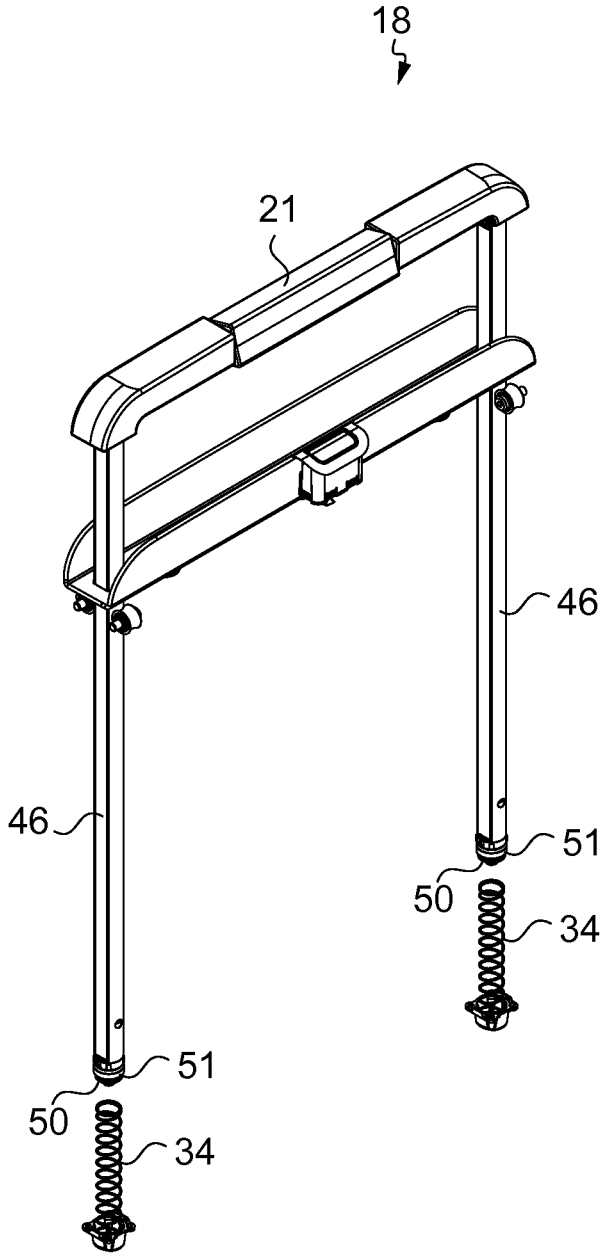
FIG. 27 is an isolated perspective view of the handle mechanism, in its configuration illustrated in FIG. 6.
Figure 28:
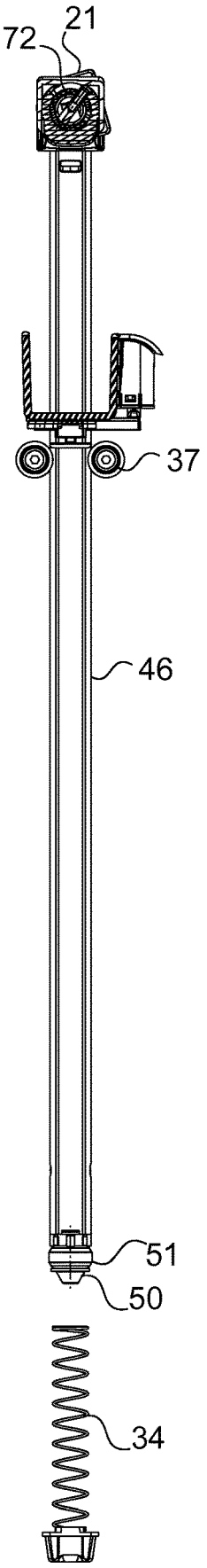
FIG. 28 is a similar cross-section to that of FIG. 19, except that it is entire and that is shows the configuration illustrated in FIGS. 6 and 27.
Figure 29:
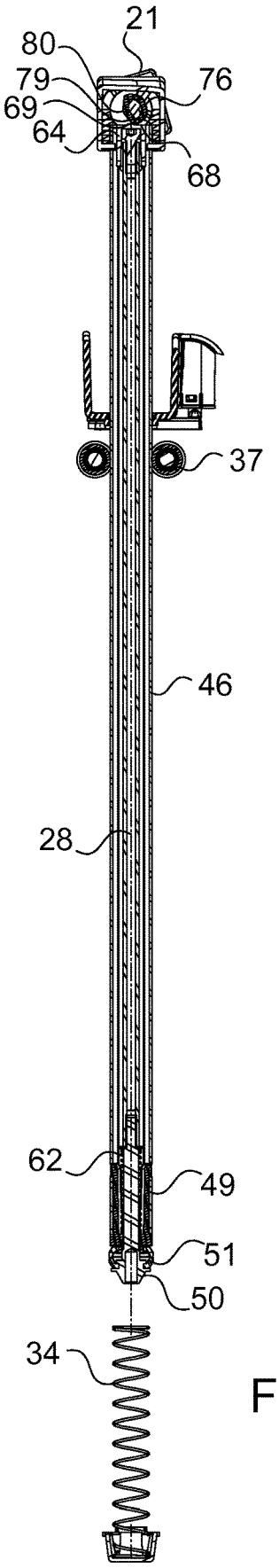
FIG. 29 is a similar cross-section to that of FIG. 20, except that it is entire and that is shows the configuration illustrated in FIGS. 6 and 27.

FIGS. 27 to 29 show the grip portion 21 of the handle 18 turned to its second position.

The projecting end 80 of the contact face 79 of the transmission tip 76 of each cam journal 71 is then located at a distance from the protrusion 69 projecting from the contact face 68 of a respective push member 64, while the profile having a general ramp shape of the contact face 79 of this transmission tip come to bear on the complementary contact face 68 of the push member 64.

The free ends of the pins 72 come into stopped engagement against the shoulder 94 provided on the wall 81 of the respective cam journal 71.

In these conditions, the tubes 48 are translationally moved and act against the elastic members 62 to move the bushing clamps 50 away from the sleeving members 49 and thus decompress the bushings 51.

The elongate members of specific cross-section 46 can thus slide in the sheaths (not illustrated) without being hindered by the bushings 51, which then only serve to guide the sliding, like the rollers 37.

The handle 18 can thus be brought into a selected position of extension.

In this selected position, the elongate members of specific cross-section 46 and the bushing clamps 50 are located away from the elastic ejection members 34.

Figure 30:
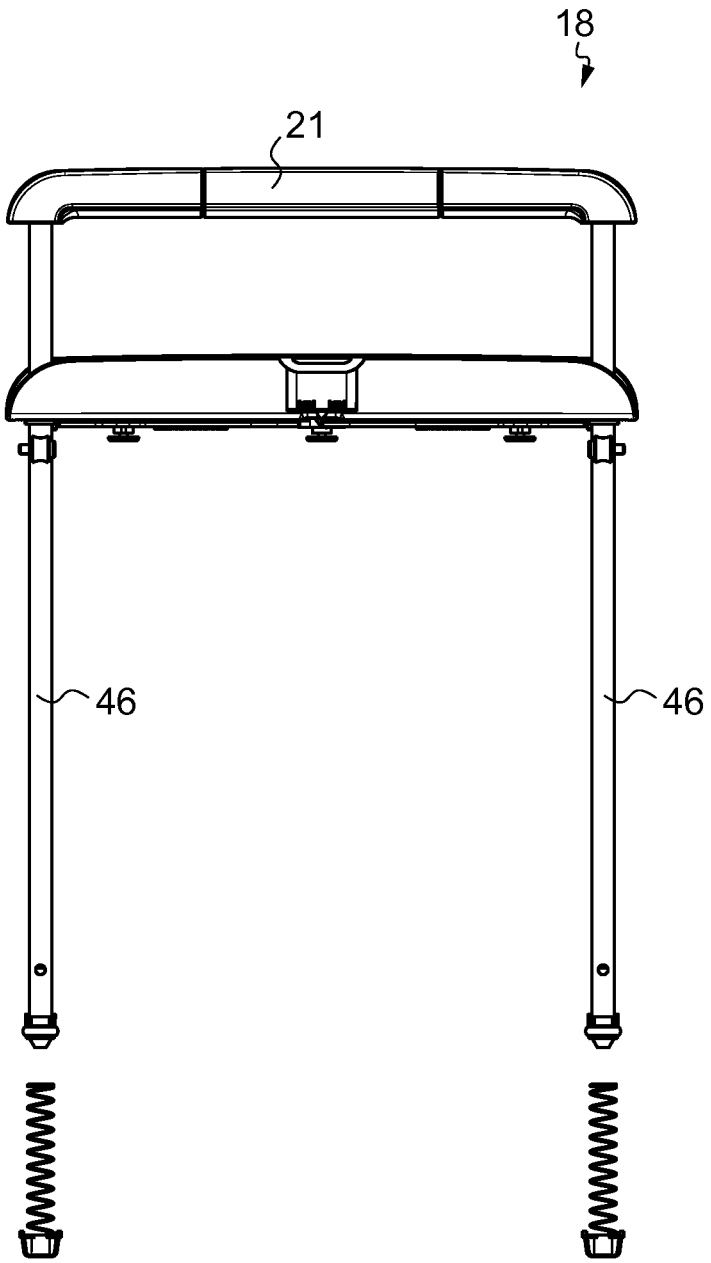
FIG. 30 is a front view showing in isolation the handle mechanism, in a locked extended configuration.
Figure 31:
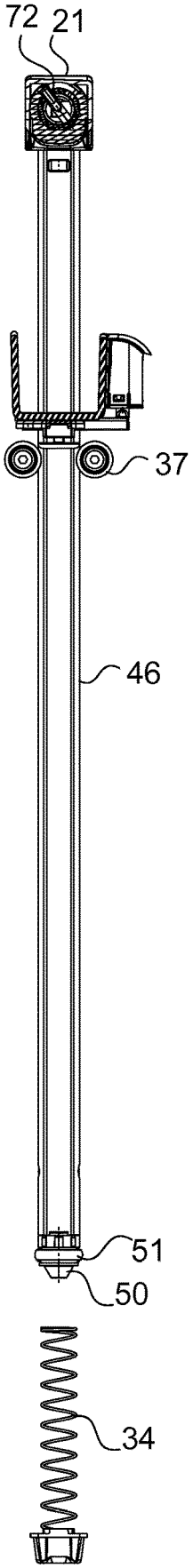
FIG. 31 is a similar view to FIG. 28, except that it shows the locked extended configuration.
Figure 32:
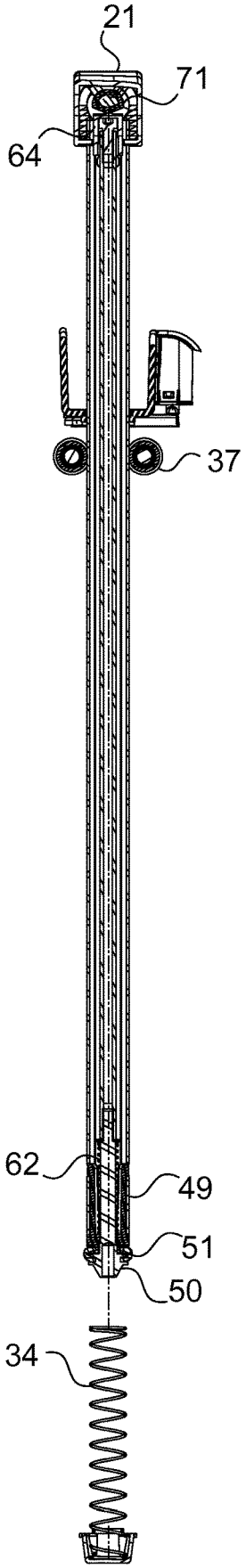
FIG. 32 is a similar view to FIG. 29, except that it shows the locked extended configuration.

FIGS. 30 to 32 show the grip portion 21 of the handle 18 brought into its first position.

The grip portion 21 is thus no longer acted upon.

The projecting end of the contact face of the transmission tip of each cam journal 71 is thus substantially in contact with the protrusion projecting from the contact face of a respective push member 64 (as in FIG. 20).

The free ends of the pins 72 have returned to being at a distance from the shoulder 94 provided on the wall 81 of the respective cam journal 71.

In these conditions, the tubes 48 are acted upon and the elastic members 62 hold the bushing clamps 50 as close as possible to the sleeving members 49 such that the bushings 51 are compressed.

The compressed bushings 51 are located here in the part of the sheaths (not illustrated) which is not provided with an enlarged internal section such that the bushings 51 hold the elongate members of specific cross-section 46 in position in the respective sheaths.

In this selected position, the elongate members of specific cross-section 46 and the bushing clamps 50 remain away from the elastic ejection members 34.

To further extend the handle 18, or to retract the handle 18, it suffices to pass the grip portion 21 again into its second position (see FIGS. 27 to 29 above).

Variants not illustrated of some features of the invention are described below.

The extendable and retractable handle mechanism may be configured such that the second position of the grip portion and of the handle axle, designated unlocking position, is a stable position, while the first position of the grip portion and of the handle axle, designated locking position, is an unstable position, the extendable and retractable handle mechanism being furthermore configured to return the grip portion and the handle axle naturally to the second position; or else each of the first and second positions may be a stable position.

The extendable and retractable handle mechanism may have a general shape of an L rather than a shape of a U, with the grip portion of the handle and the handle axle forming one branch of the L and the sheath, the elongate member of specific cross-section and the locking/unlocking system forming another branch of the L.

The grip portion of the handle and the handle axle may be located projecting from the upper lateral wall rather than in a housing of that latter. If required, it may be possible to actuate the handle mechanism before ejection of the handle, or even it could be possible for there not to be any handle ejection system.

The baggage article may be without any secure lock.

The baggage article may be without any zip fastener and simply comprise a clasp.

The baggage article is not a suitcase but a trunk, or any other article of the same kind.

More generally, it is to be noted that that the invention is not limited to the examples described and illustrated.

The invention claimed is:

1. A luggage-type baggage article, comprising:

at least two half-shells, an extendable and retractable handle mechanism which is at least partly housed in one of at least two half-shells and configured to lock or unlock a handle of the article in a position selected from a plurality of extension positions of the handle relative to said at least two half-shells, by a rotation of a grip portion of the handle, wherein the extendable and retractable handle mechanism comprises:

a handle axle to rotate the grip portion, which is mechanically connected thereto, at least one sheath mounted to be fixed in one of said at least two half-shells, at least one elongate member of a predetermined cross-section mounted to be movable in translation relative to said at least one sheath, at least one locking/unlocking system mechanically connected to said at least one elongate member and housed at least partly in said at least one sheath, at least one interface system configured to be actuated by the handle axle and to actuate said at least one locking/unlocking system, and at least one support member forming a housing for a portion of the handle axle and for said at least one interface system, said at least one support member being provided with a wall forming a guide and a stop for said at least one interface system and for the handle axle between a first position of the grip portion and of the handle axle, the at least one support member being fixed and the handle axle and the interface system being rotatably movable relative to the at least one support member, wherein said at least one locking/unlocking system locks the handle in the selected position in the first position, and wherein said at least one locking/unlocking system unlocks the handle in a second position of the grip portion and of the handle axle obtained by a rotation of the grip portion.

2. The article of claim 1, wherein the extendable and retractable handle mechanism is configured such that the first position, designated a locking position, is a stable position, and the second position, designated an unlocking position, is an unstable position; and wherein the extendable and retractable handle mechanism is configured to return the grip portion and the handle axle to the first position.

3. The article of claim 1, wherein said at least one interface system comprises a cam journal of a cylindrical shape, the cam journal mechanically connected by a first end to the handle axle, and comprising at a second end, opposite the first end, a transmission tip having a contact face configured to operate said at least one locking/unlocking system.

4. The article of claim 3, wherein the cam journal is attached onto the handle axle.

5. The article of claim 4, wherein said cam journal is mechanically connected to the handle axle using at least one fastening member passing through the handle axle; and wherein at least one free end of said at least one fastening member is accommodated in at least one window provided in the cam journal.

6. The article of claim 5, wherein said at least one fastening member is a pin.

7. The article of claim 5, wherein said at least one free end is configured to come into a stopped engagement against a shoulder of the wall forming the guide and the stop for a rotational movement of said at least one support member.

8. The article of claim 3, wherein the wall is cylindrical in shape and configured so that the cam journal is inserted through the wall, the cam journal comprising a positioning collar disposed in contact with the wall that forms the guide and the stop.

9. The article of claim 3, wherein said at least one interface system further comprises at least one elastic member mounted on the portion of the handle axle housed in said at least one support member and a spring journal mechanically connected to a first end of said at least one elastic member, the spring journal being moveably mounted on the handle axle, said at least one elastic member being interposed between the spring journal and the cam journal, and wherein a second end of said at least one elastic member, opposite the first end, is mechanically connected to a side opposite on the cam journal where the transmission tip is located.

10. The article of claim 9, wherein said at least one support member comprises a complementary wall forming a guide and a stop for translational movement for the spring journal, the complementary wall being cylindrical in shape and configured so that the spring journal is inserted through the complementary wall, and the spring journal comprising a positioning collar disposed in contact with that complementary wall.

11. The article of claim 10, wherein the complementary wall comprises a positioning cut-out configured to receive a positioning pin provided on the spring journal.

12. The article of claim 3, wherein said at least one interface system comprises at least one push member having a complementary contact face configured to directly cooperate with the contact face of the transmission tip of the cam journal; and wherein said at least one support member comprises a complementary housing provided to slidingly receive said at least one push member.

13. The article of claim 12, wherein said at least one locking/unlocking system comprises at least one tube movable inside said at least one elongate member and configured to be actuated by said at least one push member.

14. The article of claim 13, wherein said at least one locking/unlocking system comprises at least one bushing which, in the first position, is compressed and applied against an inside face of said at least one sheath to hold said at least one elongate member fixed relative to said at least one sheath, thereby locking the handle in the selected position; and wherein, in the second position, said at least one bushing is decompressed to enable free sliding of said at least one elongate member in said at least one sheath, thereby unlocking the handle.

15. The article of claim 14, wherein said at least one locking/unlocking system comprises at least one sleeving member mechanically connected to said at least one elongate member, at least one bushing clamp mechanically connected to said at least one tube and said at least one bushing being mechanically connected to both said at least one sleeving member and said at least one bushing clamp.

16. The article of claim 15, wherein said at least one locking/unlocking system is configured such that an actuation of said at least one push member by the transmission tip of the cam journal drives a translational movement of said at least one tube in the elongate member and of said at least one bushing clamp relative to said at least one sleeving member; and wherein the translational movement of said at least one bushing clamp drives a compression or a decompression of said at least one bushing in a direction of the translational movement.

17. The article of claim 1, further comprising two sheaths, two elongate members and two locking/unlocking systems; and wherein the extendable and retractable handle mechanism has a U shape, a bottom of the U is formed by the grip portion of the handle and the handle axle, and each branch of the U is formed by one sheath, one elongate member and one locking/unlocking system.

18. The article of claim 1, further comprising one sheath, one elongate member and one locking/unlocking system; and wherein the extendable and retractable handle mechanism has an L shape, a first branch of the L is formed by the grip portion of the handle and the handle axle, and a second branch of the L is formed by the sheath, the elongate member and the locking/unlocking system.

19. The article of claim 1, wherein said at least one interface system further comprises at least one elastic member mounted on the portion of the handle axle housed in said at least one support member.

20. A luggage-type baggage article, comprising:

at least two half-shells, an extendable and retractable handle mechanism which is at least partly housed in one of at least two half-shells and configured to lock or unlock a handle of the article in a position selected from a plurality of extension positions of the handle relative to said at least two half-shells, by a rotation of a grip portion of the handle, wherein the extendable and retractable handle mechanism comprises:

a handle axle to rotate the grip portion, which is mechanically connected thereto, at least one sheath mounted to be fixed in one of said at least two half-shells, at least one elongate member of a predetermined cross-section mounted to be movable in translation relative to said at least one sheath, at least one locking/unlocking system mechanically connected to said at least one elongate member and housed at least partly in said at least one sheath, at least one interface system configured to be actuated by the handle axle and to actuate said at least one locking/unlocking system, and at least one support member forming a housing for a portion of the handle axle and for said at least one interface system, said at least one support member being provided with a wall forming a guide and a stop for said at least one interface system and for the handle axle between a first position of the grip portion and of the handle axle, wherein said at least one locking/unlocking system locks the handle in the selected position in the first position, wherein said at least one locking/unlocking system unlocks the handle in a second position of the grip portion and of the handle axle obtained by a rotation of the grip portion, wherein said at least one interface system comprises a cam journal of a cylindrical shape, the cam journal mechanically connected by a first end to the handle axle, and comprising at a second end, opposite the first end, a transmission tip having a contact face configured to operate said at least one locking/unlocking system, wherein the cam journal is attached onto the handle axle, and wherein said cam journal is mechanically connected to the handle axle using at least one fastening member passing through the handle axle; and wherein at least one free end of said at least one fastening member is accommodated in at least one window provided in the cam journal.

21. A luggage-type baggage article, comprising:

at least two half-shells, an extendable and retractable handle mechanism which is at least partly housed in one of at least two half-shells and configured to lock or unlock a handle of the article in a position selected from a plurality of extension positions of the handle relative to said at least two half-shells, by a rotation of a grip portion of the handle, wherein the extendable and retractable handle mechanism comprises:

a handle axle to rotate the grip portion, which is mechanically connected thereto, at least one sheath mounted to be fixed in one of said at least two half-shells, at least one elongate member of a predetermined cross-section mounted to be movable in translation relative to said at least one sheath, at least one locking/unlocking system mechanically connected to said at least one elongate member and housed at least partly in said at least one sheath, at least one interface system configured to be actuated by the handle axle and to actuate said at least one locking/unlocking system, and at least one support member forming a housing for a portion of the handle axle and for said at least one interface system, said at least one support member being provided with a wall forming a guide and a stop for said at least one interface system and for the handle axle between a first position of the grip portion and of the handle axle, wherein said at least one locking/unlocking system locks the handle in the selected position in the first position, wherein said at least one locking/unlocking system unlocks the handle in a second position of the grip portion and of the handle axle obtained by a rotation of the grip portion, wherein said at least one interface system comprises a cam journal of a cylindrical shape, the cam journal mechanically connected by a first end to the handle axle, and comprising at a second end, opposite the first end, a transmission tip having a contact face configured to operate said at least one locking/unlocking system, and wherein the wall is cylindrical in shape and configured so that the cam journal is inserted through the wall, the cam journal comprising a positioning collar disposed in contact with the wall that forms the guide and the stop.

22. A luggage-type baggage article, comprising:

at least two half-shells, an extendable and retractable handle mechanism which is at least partly housed in one of at least two half-shells and configured to lock or unlock a handle of the article in a position selected from a plurality of extension positions of the handle relative to said at least two half-shells, by a rotation of a grip portion of the handle, wherein the extendable and retractable handle mechanism comprises:

a handle axle to rotate the grip portion, which is mechanically connected thereto, at least one sheath mounted to be fixed in one of said at least two half-shells, at least one elongate member of a predetermined cross-section mounted to be movable in translation relative to said at least one sheath, at least one locking/unlocking system mechanically connected to said at least one elongate member and housed at least partly in said at least one sheath, at least one interface system configured to be actuated by the handle axle and to actuate said at least one locking/unlocking system, and at least one support member forming a housing for a portion of the handle axle and for said at least one interface system, said at least one support member being provided with a wall forming a guide and a stop for said at least one interface system and for the handle axle between a first position of the grip portion and of the handle axle, wherein said at least one locking/unlocking system locks the handle in the selected position in the first position, wherein said at least one locking/unlocking system unlocks the handle in a second position of the grip portion and of the handle axle obtained by a rotation of the grip portion, and wherein said at least one interface system further comprises at least one elastic member mounted on the portion of the handle axle housed in said at least one support member.

23. A luggage-type baggage article, comprising:

at least two half-shells, an extendable and retractable handle mechanism which is at least partly housed in one of at least two half-shells and configured to lock or unlock a handle of the article in a position selected from a plurality of extension positions of the handle relative to said at least two half-shells, by a rotation of a grip portion of the handle, wherein the extendable and retractable handle mechanism comprises:

a handle axle to rotate the grip portion, which is mechanically connected thereto, at least one sheath mounted to be fixed in one of said at least two half-shells, at least one elongate member of a predetermined cross-section mounted to be movable in translation relative to said at least one sheath, at least one locking/unlocking system mechanically connected to said at least one elongate member and housed at least partly in said at least one sheath, at least one interface system configured to be actuated by the handle axle and to actuate said at least one locking/unlocking system, and at least one support member forming a housing for a portion of the handle axle and for said at least one interface system, said at least one support member being provided with a wall forming a guide and a stop for said at least one interface system and for the handle axle between a first position of the grip portion and of the handle axle, wherein said at least one locking/unlocking system locks the handle in the selected position in the first position, wherein said at least one locking/unlocking system unlocks the handle in a second position of the grip portion and of the handle axle obtained by a rotation of the grip portion, wherein said at least one interface system comprises a cam journal of a cylindrical shape, the cam journal mechanically connected by a first end to the handle axle, and comprising at a second end, opposite the first end, a transmission tip having a contact face configured to operate said at least one locking/unlocking system, wherein said at least one interface system comprises at least one push member having a complementary contact face configured to directly cooperate with the contact face of the transmission tip of the cam journal, wherein said at least one support member comprises a complementary housing provided to slidingly receive said at least one push member, and wherein said at least one locking/unlocking system comprises at least one tube movable inside said at least one elongate member and configured to be actuated by said at least one push member.

24. A luggage-type baggage article, comprising:

at least two half-shells, an extendable and retractable handle mechanism which is at least partly housed in one of at least two half-shells and configured to lock or unlock a handle of the article in a position selected from a plurality of extension positions of the handle relative to said at least two half-shells, by a rotation of a grip portion of the handle, wherein the extendable and retractable handle mechanism comprises:

a handle axle to rotate the grip portion, which is mechanically connected thereto, at least one sheath mounted to be fixed in one of said at least two half-shells, at least one elongate member of a predetermined cross-section mounted to be movable in translation relative to said at least one sheath, at least one locking/unlocking system mechanically connected to said at least one elongate member and housed at least partly in said at least one sheath, at least one interface system configured to be actuated by the handle axle and to actuate said at least one locking/unlocking system, and at least one support member forming a housing for a portion of the handle axle and for said at least one interface system, said at least one support member being provided with a wall forming a guide and a stop for said at least one interface system and for the handle axle between a first position of the grip portion and of the handle axle, the at least one support member being fixed and the handle axle and the interface system being rotatably movable relative to the at least one support member, wherein said at least one locking/unlocking system locks the handle in the selected position in the first position, wherein said at least one locking/unlocking system unlocks the handle in a second position of the grip portion and of the handle axle obtained by a rotation of the grip portion, wherein said at least one interface system comprises a cam journal of a cylindrical shape, the cam journal mechanically connected by a first end to the handle axle, and comprising at a second end, opposite the first end, a transmission tip having a contact face configured to operate said at least one locking/unlocking system, and wherein said at least one interface system further comprises at least one elastic member mounted on the portion of the handle axle housed in said at least one support member and a spring journal mechanically connected to a first end of said at least one elastic member, the spring journal being moveably mounted on the handle axle, said at least one elastic member being interposed between the spring journal and the cam journal, and wherein a second end of said at least one elastic member, opposite the first end, is mechanically connected to a side opposite on the cam journal where the transmission tip is located.

* * * * *